US009427672B2

(12) United States Patent
Picolet et al.

(10) Patent No.: US 9,427,672 B2
(45) Date of Patent: Aug. 30, 2016

(54) STUNT ARENAS FOR REMOTE CONTROL VEHICLES

(71) Applicant: Objex Design, St. Louis, MO (US)

(72) Inventors: Dale Picolet, St. Louis, MO (US); Chad Stuemke, St. Louis, MO (US); Jake Salter, St. Louis, MO (US); Corey Feit, St. Louis, MO (US); Andy Wiseman, Bella Vista, AR (US)

(73) Assignee: OBJEX DESIGN, St. Louis, MO (US)

( * ) Notice: Subject to any disclaimer, the term of this patent is extended or adjusted under 35 U.S.C. 154(b) by 0 days.

(21) Appl. No.: 14/175,428

(22) Filed: Feb. 7, 2014

(65) Prior Publication Data

US 2014/0221111 A1 Aug. 7, 2014

Related U.S. Application Data

(60) Provisional application No. 61/762,058, filed on Feb. 7, 2013.

(51) Int. Cl.

| | |
|---|---|
| ***A63H 18/00*** | (2006.01) |
| ***A63H 18/02*** | (2006.01) |
| *E01B 23/00* | (2006.01) |

(52) U.S. Cl.

CPC ..... *A63H 18/00* (2013.01); *A63H 18/028* (2013.01)

(58) Field of Classification Search

CPC .... A63H 18/00; A63H 18/02; A63H 18/028; A63H 18/026; A63H 18/12; E01B 23/00

USPC ..... 446/168, 444, 454, 455, 456; 238/10 A, 238/10 E

See application file for complete search history.

(56) References Cited

U.S. PATENT DOCUMENTS

| | | | | |
|---|---|---|---|---|
| 2,064,309 | A | | 12/1936 | Lohr |
| 2,247,354 | A | | 7/1941 | Berger |
| 3,402,503 | A | | 9/1968 | Glass et al. |
| 3,414,194 | A | | 12/1968 | Seitzinger et al. |
| 3,540,068 | A | | 11/1970 | Bouthors |
| 3,621,602 | A | * | 11/1971 | Barcus et al. ..... 446/491 |
| 3,814,021 | A | | 6/1974 | McHenry |
| 3,858,875 | A | * | 1/1975 | Nemeth ..... A63H 18/02 104/54 |
| 3,885,502 | A | | 5/1975 | Sarno et al. |
| 4,300,308 | A | | 11/1981 | Ikeda |
| 4,425,735 | A | | 1/1984 | Kulesza et al. |
| 4,504,243 | A | | 3/1985 | Barlow et al. |
| 4,516,953 | A | * | 5/1985 | Hippely et al. ..... 446/444 |
| 4,550,910 | A | * | 11/1985 | Goldfarb et al. ..... 104/305 |
| 4,563,626 | A | | 1/1986 | Ohtake |
| 4,767,053 | A | | 8/1988 | Cook et al. |
| D306,466 | S | | 3/1990 | Elliott et al. |
| 4,953,786 | A | | 9/1990 | Arsenault |
| 4,969,851 | A | | 11/1990 | Rasmussen |
| 5,102,133 | A | * | 4/1992 | Chilton et al. ..... 238/10 F |

(Continued)

*Primary Examiner* — Kien Nguyen

(74) *Attorney, Agent, or Firm* — Harness, Dickey & Pierce, P.L.C.

(57) ABSTRACT

A remote control vehicle, a remote control for use in controlling the vehicle, and an arena in which the vehicle can be operated, via the remote control, to engage stunts and perform acrobatic maneuvers are provided. The remote control has a charging port for receiving and charging a battery configured for use with the remote control vehicle. And, the arena includes stunts and fences disposed along part of an outer portion of the arena. The remote control vehicle is operable, via the remote control, in the arena to engage the stunts and perform acrobatic maneuvers within the arena.

20 Claims, 16 Drawing Sheets

(56) References Cited

U.S. PATENT DOCUMENTS

| | | | | |
|---|---|---|---|---|
| 5,158,495 | A | 10/1992 | Yonezawa | |
| 5,334,076 | A | 8/1994 | Shinozuka | |
| 5,630,743 | A | 5/1997 | Shi | |
| 5,702,107 | A | 12/1997 | Novak | |
| 5,727,985 | A | 3/1998 | George et al. | |
| 5,919,075 | A | 7/1999 | George et al. | |
| 6,095,890 | A | 8/2000 | George et al. | |
| 6,224,454 | B1 | 5/2001 | Cheng et al. | |
| 6,427,926 | B1 | 8/2002 | Lai | |
| 6,695,668 | B2 | 2/2004 | Donahue et al. | |
| 6,780,077 | B2 | 8/2004 | Baumgartner et al. | |
| 6,908,396 | B1 | 6/2005 | Billig | |
| 6,913,507 | B2 | 7/2005 | Hui | |
| 6,957,996 | B2 | 10/2005 | Hui | |
| 7,101,250 | B2 | 9/2006 | Lam et al. | |
| 7,288,917 | B2 | 10/2007 | Art et al. | |
| 7,387,559 | B2 | 6/2008 | Sanchez-Castro et al. | |
| 7,470,166 | B2 | 12/2008 | Allen | |
| 7,690,964 | B2 | 4/2010 | Nuttall et al. | |
| 7,749,043 | B1 | 7/2010 | Rehkemper et al. | |
| 7,758,399 | B2 | 7/2010 | Weiss et al. | |
| D624,608 | S | 9/2010 | Yuen | |
| 7,946,903 | B2 | 5/2011 | Sheltman | |
| 8,038,504 | B1 | 10/2011 | Wong | |
| 8,567,690 | B2 * | 10/2013 | De La Torre | 238/10 E |
| 2002/0132556 | A1 | 9/2002 | So | |
| 2007/0049160 | A1 * | 3/2007 | Matthes et al. | 446/444 |
| 2007/0298679 | A1 | 12/2007 | Perego | |
| 2009/0149113 | A1 | 6/2009 | Lund et al. | |
| 2010/0130097 | A1 | 5/2010 | Giraldez et al. | |
| 2010/0230198 | A1 | 9/2010 | Frank et al. | |
| 2010/0261405 | A1 | 10/2010 | Hornsby et al. | |
| 2010/0261406 | A1 | 10/2010 | Hornsby et al. | |
| 2010/0261408 | A1 | 10/2010 | Hornsby et al. | |
| 2011/0021110 | A1 | 1/2011 | Hippely et al. | |
| 2011/0053456 | A1 | 3/2011 | Ostendorff et al. | |
| 2011/0250822 | A1 | 10/2011 | Koehl | |

* cited by examiner

STUNT ARENAS FOR REMOTE CONTROL VEHICLES

CROSS-REFERENCE TO RELATED APPLICATION

This application claims the benefit of and priority to U.S. Provisional Application No. 61/762,058, filed on Feb. 7, 2013. The entire disclosure of the above application is incorporated herein by reference.

FIELD

The present disclosure generally relates to remote control vehicles, to remote controls for use with the remote control vehicles, and to arenas in which the remote control vehicles can be operated to engage stunts and perform acrobatic maneuvers (e.g., jumps, flips, rolls, etc.).

BACKGROUND

This section provides background information related to the present disclosure which is not necessarily prior art.

Remote control vehicles are available for racing, jumping, and performing other actions. Such vehicles may be used in environments without barriers (e.g., in open rooms, in open lots, etc.). Or, such vehicles may be used in environments with barriers (e.g., race tracks, etc.) in which the vehicles move (e.g., race, etc.) repeatedly around pre-defined paths (e.g., for time, for speed, against other vehicles, etc.).

SUMMARY

This section provides a general summary of the disclosure, and is not a comprehensive disclosure of its full scope or all of its features.

The present disclosure is generally directed toward arenas in which remote control vehicles can be used. In one example embodiment, a stunt arena for use with a remote control vehicle generally includes multiple stunts engageable by the remote control vehicle within the stunt arena to perform acrobatic maneuvers within the stunt arena.

The present disclosure is also generally directed toward assemblies comprising remote control vehicles and arenas. In one example embodiment, such an assembly generally includes a remote control vehicle and an arena. The arena has fences disposed along part of an outer portion of the arena and stunts disposed along part of the outer portion of the arena generally between the fences. The remote control vehicle is operable in the arena to engage the stunts and perform acrobatic maneuvers within the arena.

The present disclosure is also generally directed toward remote controls for use with remote control vehicles. In one example embodiment, such a remote control generally includes a charging port for receiving and charging a battery of a remote control vehicle (e.g., a remote control vehicle associated with the remote control, etc.).

The present disclosure is also generally directed toward remote control vehicles. In one example embodiment, such a remote control vehicle is configured for use with an arena comprising multiple stunts engageable by the remote control vehicle to perform acrobatic maneuvers within the arena. The remote control vehicle includes a chassis and wheels coupled to the chassis. The wheels of the remote control vehicle are not steerable.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments of the present disclosure generally relate to arenas for remote control vehicles. The vehicles are generally user controlled. And, the arenas include various stunts (e.g., ramps, jumps, barrels, loops, tunnels, etc.), where the vehicles are free to move throughout the arenas to engage the stunts and perform desired maneuvers (e.g., jumps, flips, rolls, etc.). The stunts can be arranged in various desired play patterns. What's more, the vehicles are free to drive anywhere in the arenas (in any desired paths, patterns, etc.) to engage the stunts in any desired order, combination, etc. and/or at any desired angle, speed, etc. As such, the movement of the vehicles around the arenas is substantially free-form (e.g., free of slots in the arenas, guides in the arenas, specific track patterns in the arena, etc. that would control, direct, dictate, etc. specific paths of movement of the vehicles in the arenas, etc.).

Example embodiments of the present disclosure also generally relate to remote control vehicles and remote controls for use with such vehicles, where the remote control vehicles can be used in arenas of the present disclosure (via control using the remote controls). In some aspects, the remote controls including charging ports for charging batteries used to operate the remote control vehicles. As such, one battery can be installed to vehicles being controlled by a remote control and another vehicle battery can be plugged into a charging port of the remote control for charging.

Figure 1:
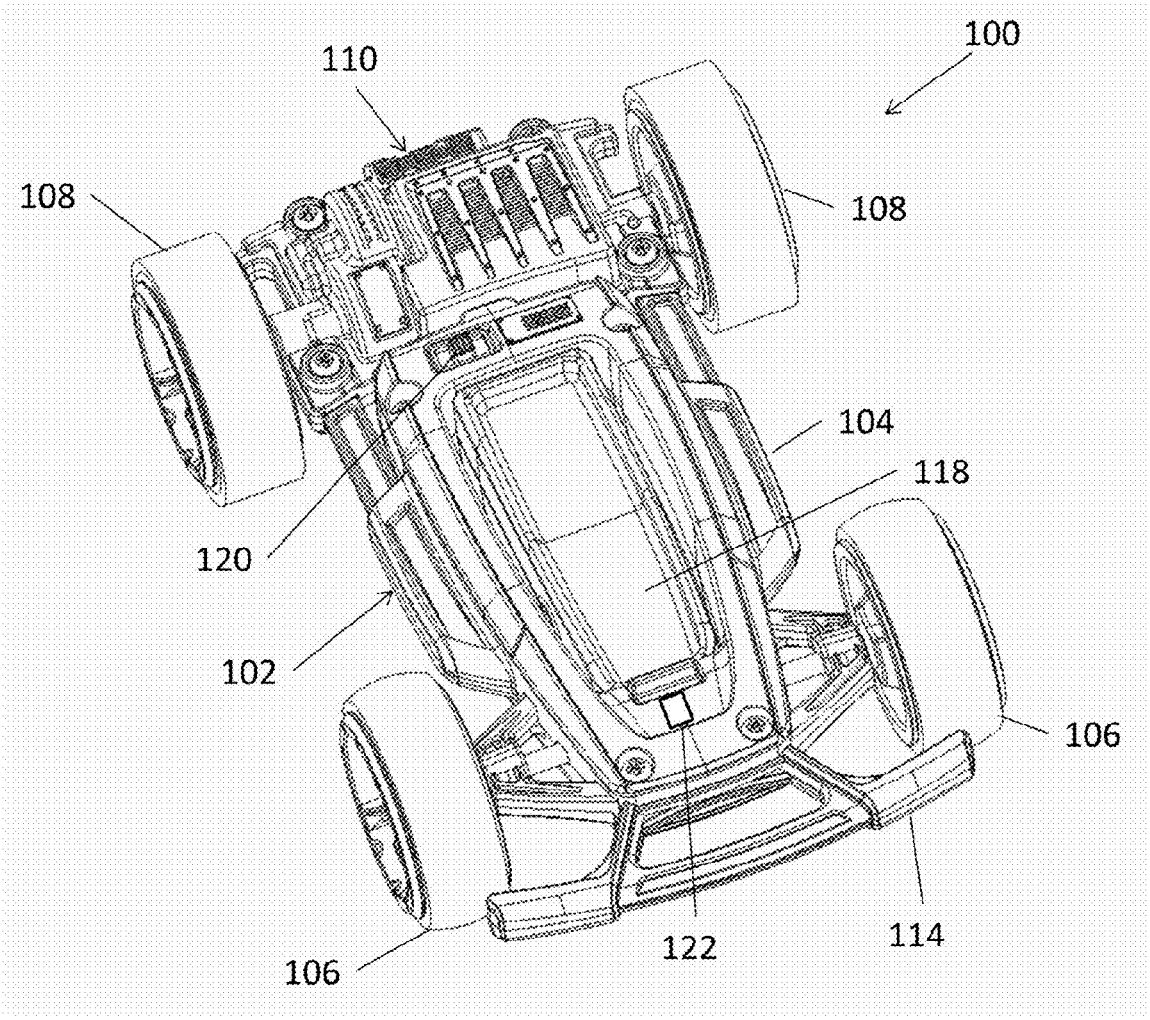
FIG. 1 is a perspective view of a remote control vehicle according to an example embodiment of the present disclosure.
Figure 2:
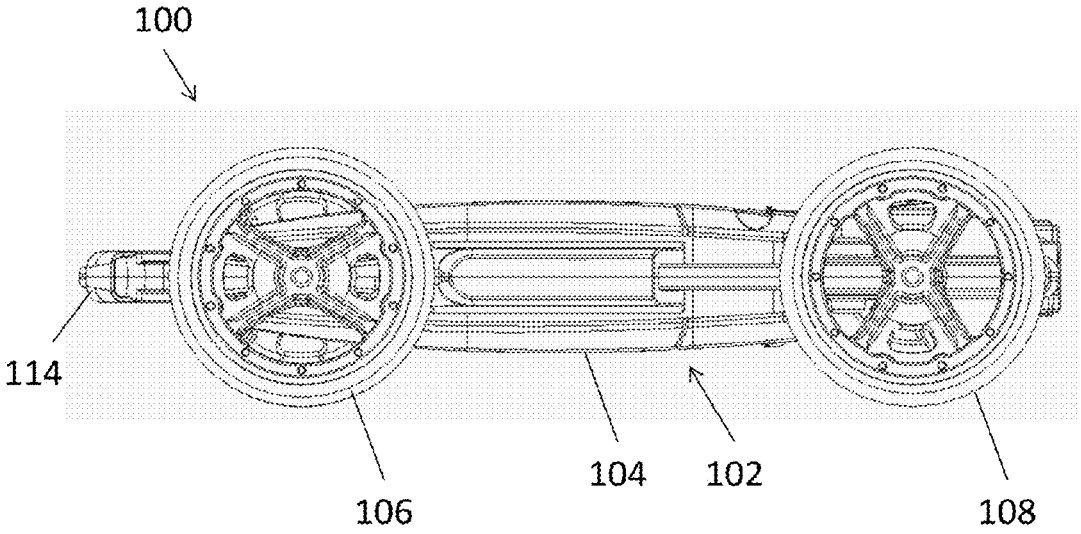
FIG. 2 is a side view of the remote control vehicle of FIG. 1.

With reference now to the drawings, FIGS. 1 and 2 illustrate a remote control vehicle 100 according to an example embodiment of the present disclosure. The remote control vehicle 100 can be used in connection with any of the stunt arenas, remote controls, assemblies, etc. disclosed herein.

The illustrated vehicle 100 generally includes a chassis 102 having a frame 104, forward wheels 106, rearward wheels 108, and a drive motor 110 (with suitable gearing). A forward portion of the frame includes a bumper 114, and a rearward portion of the frame defines a compartment configured to house the drive motor 110. A central portion of the frame defines a compartment for holding a battery 118 (e.g., via clips, etc.) used to power the drive motor 110 of the vehicle 100. The battery 118 of the vehicle 100 is a removable and rechargeable battery 118 (e.g., a rechargeable lithium-polymer battery, etc.). And, the battery 118 is configured to be easily installed into and removed from the vehicle 100. Wiring (e.g., via quick connect electrical connections, etc.) is provided to couple the battery 118 to the drive motor 110 to provide power. A switch 120 is provided to activate/deactivate power to the vehicle 100 as desired.

The drive motor 110 of the vehicle 100 is configured to operate the rearward wheels 108 of the vehicle 100. In one operational setting, the drive motor 110 can operate the rearward wheels 108 of the vehicle 100 in a forward direction (e.g., in a counter-clockwise direction as viewed in FIG. 2, etc.) for moving the vehicle 100 generally forward. And in another operational setting, the drive motor 110 can reverse action and operate the rearward wheels 108 of the vehicle 100 in a rearward direction (e.g., in a clockwise direction as viewed in FIG. 2, etc.) for moving the vehicle 100 generally backward. The operational setting of the drive motor 110 can be remotely controlled and selectively changed as desired (e.g., via a remote control, etc.). In other example embodiments, vehicles may include drive motors configured to operate forward wheels of the vehicles, or drive motors configured to operate forward wheels and rearward wheels of the vehicles, or multiple drive motors configured to operate forward wheels and/or rearward wheels of the vehicles as desired.

The vehicle 100 also includes a controller configured to direct operation of the vehicle 100 (e.g., by controlling the drive motor 110, etc.). For example, the controller may direct desired movement of the vehicle 100 (e.g., generally forward movement of the vehicle 100, generally backward movement of the vehicle 100, etc.), speed of the vehicle 100, power to the vehicle 100, various combinations thereof, other desired operations associated with the vehicle 100, etc. In so doing, the controller may receive and/or send information (e.g., via radio signals, via infrared signals, etc.) from and/or to a remote control associated with the vehicle 100.

In addition, the controller is also configured to perform failsafe functions relating to the operation of the vehicle 100. For example, the controller may monitor charge level of the battery 118 and provide an indication, warning, etc. if it falls below a predetermined threshold. Among other things, this can help prevent damage to the battery 118 and/or help prolong operational life of the battery 118. The controller may also monitor rotation of the wheels 106 and/or 108 of the vehicle 100 and deactivate power to the drive motor 110 if the wheels 106 and/or 108 are stopped, for example, by an outside force, etc. for a predetermined period of time (e.g., to help prevent the drive motor 110 from becoming damaged, etc.). The controller may then reactivate power to the drive motor 110 after the drive motor 110 completely stops.

With continued reference to FIGS. 1 and 2, an overall height of the chassis 102 of the vehicle 100 is less than a diameter of each of the wheels 106, 108. As such, the vehicle 100 is capable of driving on its top (as illustrated in FIGS. 1 and 2) or on its bottom. This allows the vehicle 100 to always appear to the user to be in a generally forward driving orientation, for example, when landing after performing maneuvers in an arena, etc. To accommodate this operation, a tilt switch (or other suitable device for sensing orientation of the vehicle 100 relative to gravity) is provided with the vehicle 100 (e.g., included on a circuit board of the vehicle 100 in communication with the controller, etc.). The tilt switch is operable to reverse the operational setting of the drive motor 110 when the vehicle 100 turns upside down. This feature helps keep the vehicle 100 always driving forward (as viewed by a user), regardless of which side is up. This feature also allows for the same use, operation, etc. of a remote control (associated with the vehicle 100) to drive the vehicle 100 regardless of whether it is right-side up or upside down.

The vehicle 100 also includes a light 122 coupled to the frame 104. The light 122 is configured to illuminate a path in which the vehicle 100 is moving. The light 122 can include any desired light within the scope of the present disclosure, for example, white light, ultraviolet light, black light, etc. In addition, while only one light 122 is illustrated in FIG. 1, it should be appreciated that multiple lights may be used in the vehicle 100, for example, at different positions along the frame 104 and/or at one or more positions on the top and bottom of the frame 104 (such that the lights can illuminate a path in which the vehicle 100 is moving regardless of direction of movement and/or orientation of the vehicle 100).

In the illustrated embodiment, the drive motor 110 of the vehicle 100 is a variable speed motor 110. As such, the drive motor 110 can operate the rearward wheels 108 of the vehicle 100 at different speeds, thereby allowing the vehicle 100 to move at different desired speeds (e.g., across an arena, into engagement with stunts, etc.). In other example embodiments, vehicles may include constant speed drive motors, or any other suitable drive motors, within the scope of the present disclosure.

Also in the illustrated embodiment, neither the forward wheels 106 nor the rearward wheels 108 of the vehicle 100 are steerable. As such, the vehicle 100 is configured for movement only generally forward and only generally backward (depending on the operational setting of the drive motor 110). In other example embodiments, however, vehicles may include forward wheels and/or rearward wheels that are steerable within the scope of the present disclosure (e.g., via a remote control, etc.).

Figure 3:
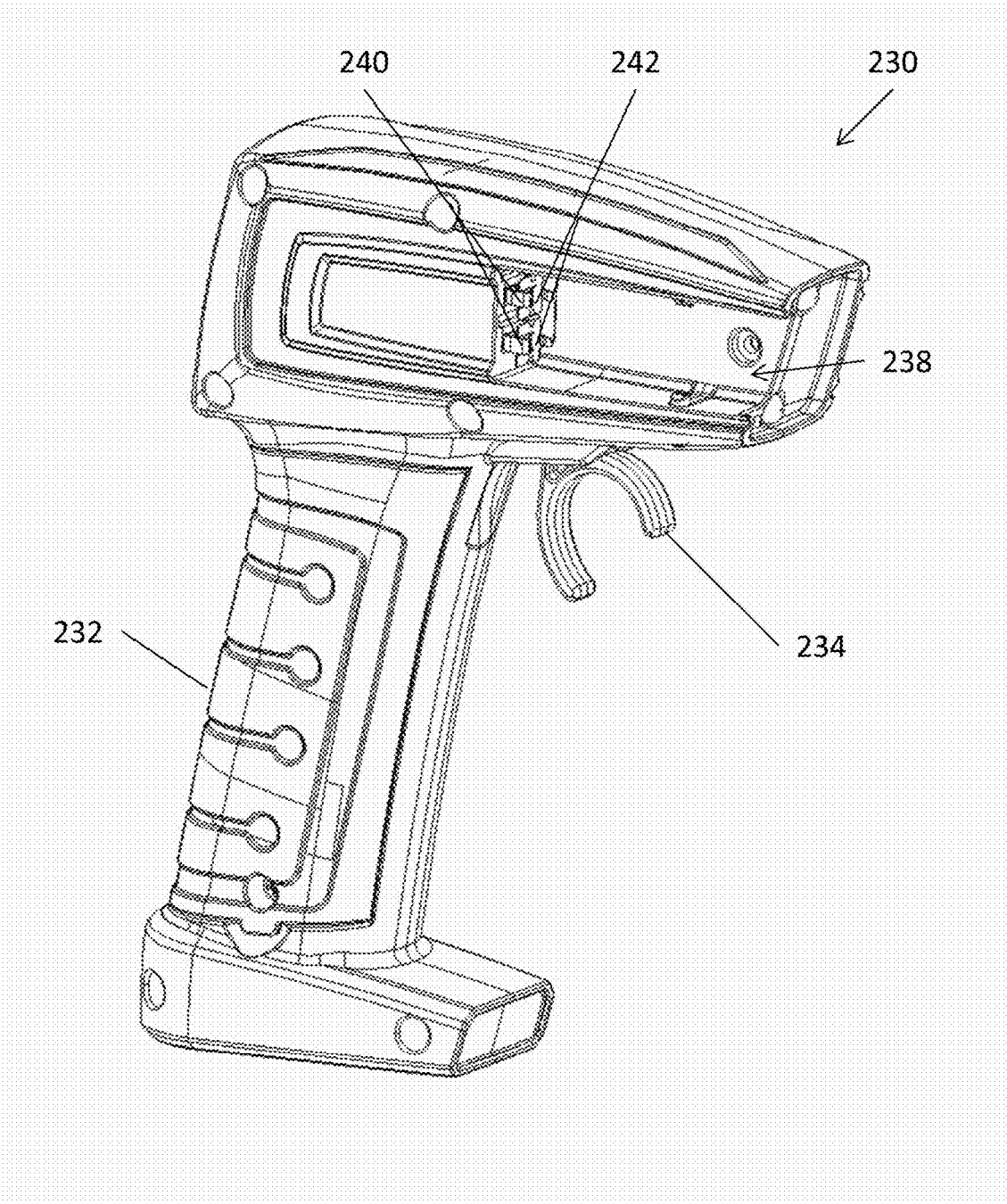
FIG. 3 is a perspective view of a remote control according to an example embodiment of the present disclosure, where the remote control is operable to control a remote control vehicle.
Figure 4:
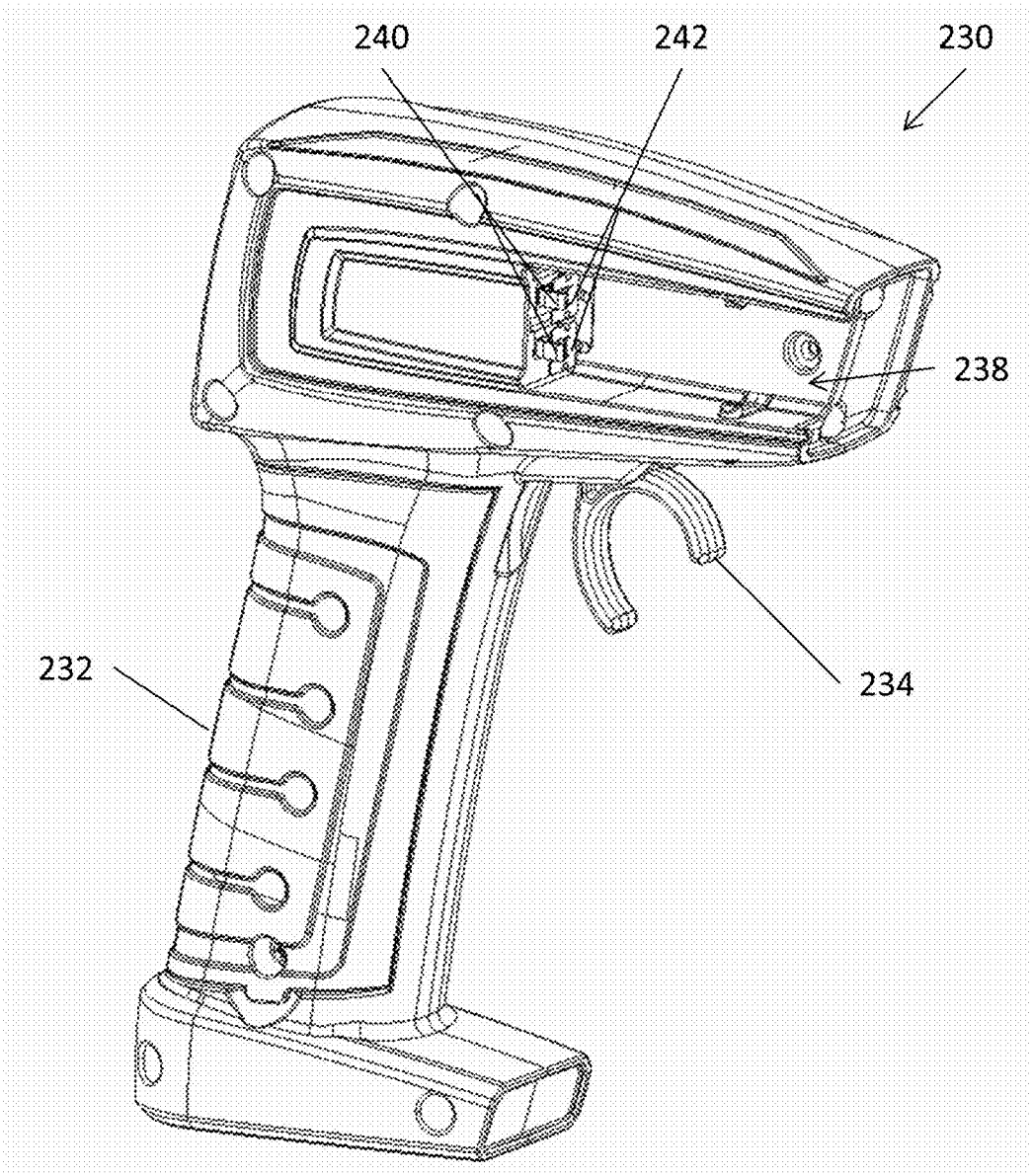
FIG. 4 is a perspective view of the remote control of FIG. 3, further illustrating a battery for a remote control vehicle disposed in a charging port of the remote control.

FIGS. 3 and 4 illustrate a remote control 230 according to an example embodiment of the present disclosure. The remote control 230 is configured to control operation of a remote control vehicle. As an example, the remote control 230 can be used to control operation of the remote control vehicle 100 previously described and illustrated in FIGS. 1 and 2, the remote control vehicle 300 described hereinafter and illustrated in FIGS. 5-8, etc. Further, the remote control 230 can be used in connection with any of the example embodiments of remote control vehicles, arenas, assemblies, etc. described herein.

The illustrated remote control 230 generally includes a handle 232 and a trigger 234 (broadly, an actuator) arranged in a pistol-type configuration. A suitable communication device is provided with the remote control 230 for communicating (e.g., via radio signals, infrared signals, etc.) with a remote control vehicle (e.g., with the controller of vehicle 100, etc.) and controlling operation of the vehicle. The handle 232 includes a port for receiving batteries (e.g., AA batteries, etc.) to power the remote control 230. In other example embodiments, remote controls may have configurations other than pistol-type configurations.

In use, the remote control 230 is configured to operate a remote control vehicle without steering (e.g., the remote control vehicle 100, etc.). As such, actuating the trigger 234 forward and backward functions to control, change, etc. movement of the vehicle (e.g., controls operational settings of a drive motor of the vehicle to control speed, direction, etc. of the vehicle, etc.). For example, pulling the trigger 234 toward the handle 232 drives the vehicle generally forward, and pushing the trigger 234 away from the handle 232 drives the vehicle generally backward. What's more, where the vehicle includes a variable speed drive motor (as in vehicle 100), the remote control 230 allows for variable speed operation of the vehicle, where pulling the trigger 234 slightly moves the vehicle slowly, and pulling the trigger 234 all the way moves the vehicle at max speed. In addition, where the vehicle is configured to drive right-side up and upside down (and includes a tilt switch, as in vehicle 100), pulling the trigger 234 toward the handle 232 drives the vehicle generally forward regardless of whether the vehicle is right-side up or upside down, and pushing the trigger 234 away from the handle 232 drives the vehicle generally backward regardless of whether the vehicle is right-side up or upside down. In other example embodiments, remote controls may be configured to control vehicles in which wheels of the vehicles are steerable. Here, the remote controls may then include features for steering the vehicles (e.g., wheels, knobs, other actuators, etc.).

The remote control 230 also includes a charging port 238 configured to receive and charge a battery 218 (FIG. 4) of a remote control vehicle (e.g., battery 118 of remote control vehicle 100, etc.). In the illustrated embodiment, the charging port 238 includes clips 240 for securing the battery 218 on the remote control 230, and electrical contacts 242 for coupling to and charging the battery 218. As such, one battery can be installed to the vehicle being controlled by the remote control 230 and another battery can be plugged into the charging port 238 of the remote control 230 for charging (e.g., while a user continues to play with the vehicle, while the vehicle and/or remote control 230 are idle, etc.). In other example embodiments, remote controls may include multiple charging ports configured to receive and charge multiple batteries of remote control vehicles.

FIGS. 5-8 illustrate an arena 350 (e.g., a stunt arena, etc.) according to an example embodiment of the present disclosure. The remote control vehicle 100 and the remote control 230 previously described and illustrated in FIGS. 1-4 can be used in connection with the arena 350, for example, to perform desired maneuvers, etc.

Figure 5:
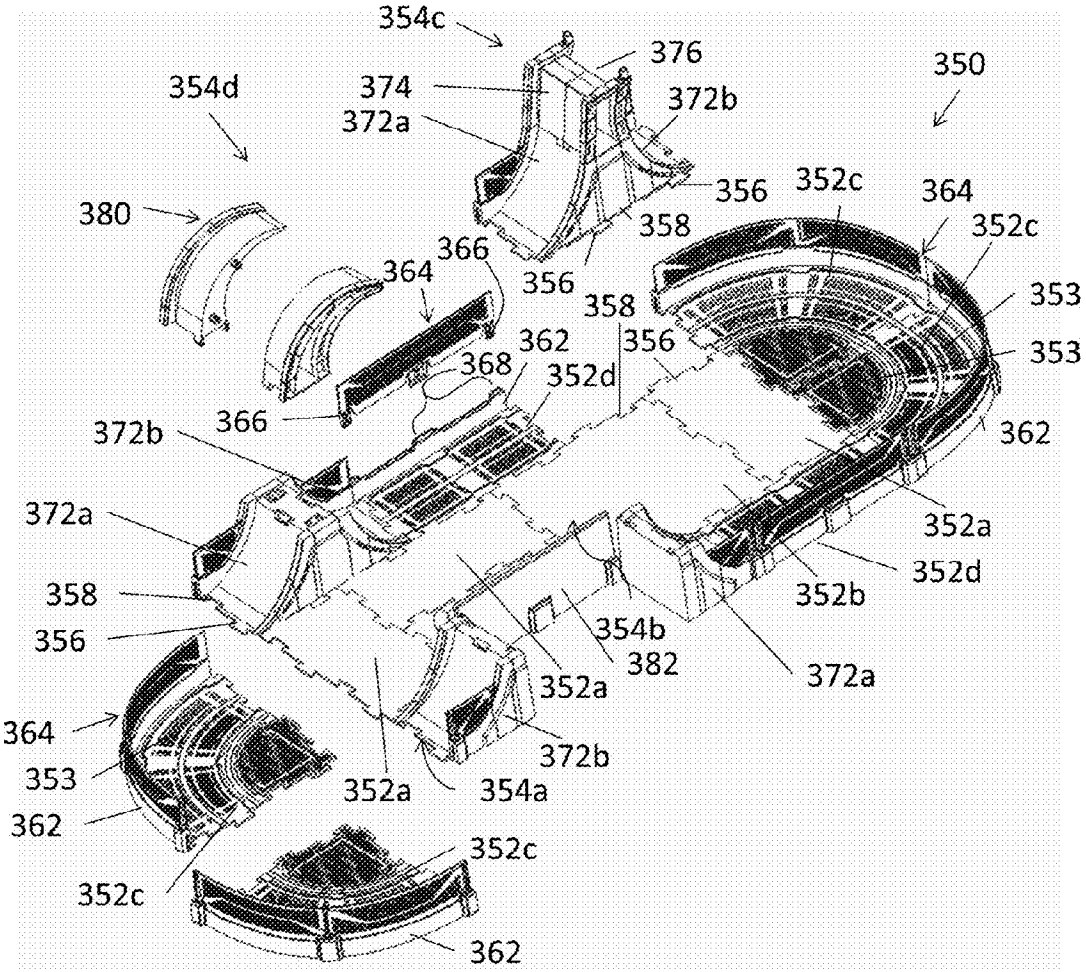
FIG. 5 is an exploded perspective view of an arena according to an example embodiment of the present disclosure, where a remote control vehicle can be used in the arena to engage various stunts and perform various acrobatic maneuvers.

As shown in FIG. 5, the arena 350 includes multiple tiles 352*a-d* and multiple stunts 354*a-d* arranged to form the arena 350. The tiles 352*a-d* are generally flat and form a floor (e.g., a driving surface, etc.) of the arena 350 on which a remote control vehicle 300 can drive. And, the stunts 354*a-d* are positioned at various locations around the floor so that the remote control vehicle 300 can selectively engage the stunts 354*a-d* as it drives across the floor. The tiles 352*a-d* and the stunts 354*a-d* are configured to interlock with adjacent tiles 352*a-d* and/or stunts 354*a-d* to help hold them in place, together, etc. in desired configurations (e.g., in the configuration shown in FIG. 5, in other configurations described herein, in still other desired configurations, etc.). This helps provide a smooth transition between the tiles 352*a-d* and the stunts 354*a-d* for driving the vehicle 300. In the illustrated embodiment, various edges of the tiles 352*a-d* and the stunts 354*a-d* include teeth 356 configured to fit into corresponding openings 358 located in edges of adjacent tiles 352*a-d* and/or stunts 354*a-d* to thereby interlock them. In other example embodiments, arenas may include tiles and/or stunts with other structures (e.g., other configurations of releasable fasteners, etc.) configured to interlock adjacent tiles and/or stunts as desired.

The tiles 352*a*, 352*b* define inner tiles of the arena 350, and the tiles 352*c*, 352*d* define outer tiles of the arena 350. The outer tiles 352*c*, 352*d* are positioned generally around the inner tiles 352*a*, 352*b* at various locations to define part of an outer boundary of the arena 350. In addition in the illustrated embodiment, the outer tiles 352*c* are curved outer tiles, and the outer tiles 352*d* are straight outer tiles. The curved outer tiles 352*c* are positioned generally toward end portions of the arena 350, and the strait outer tiles 352*d* are positioned generally between the curved outer tiles 352*c*.

Each of the outer tiles 352*c*, 352*d* of the arena 350 includes a raised lip 362 extending along outer side portions of the tiles 352*c*, 352*d*. Fences 364 are coupled to the lips 362 of the outer tiles 352*c*, 352*d*. In the illustrated embodiment, the fences 364 include legs 366 configured to fit into corresponding openings 368 in the lips 362 of the outer tiles 352*c*, 352*d* to secure the fences 364 to the tiles 352*c*, 352*d*. In addition, the fences 364 include side tabs configured to interlock adjacent fences 364 together (and help secure adjacent tiles 352*c*, 352*d* together). Together, these features help further secure the tiles 352*c*, 352*d* of the arena 350 together, to thereby provide smooth transitions between the fences 364 and the lips 362 of the outer tiles 352*c*, 352*d* and between the adjacent fences 364. In other example embodiments, arenas may include fences with other structures (e.g., other configurations of fasteners, other configurations of tabs on fences, other numbers of tabs on fences, etc.) configured to couple the fences to tiles, to adjacent fences, etc. as desired. And in still other example embodiments, arenas may include tiles with fences formed integrally, monolithically, as one piece, etc. therewith.

The outer tiles 352*c*, 352*d* of the arena 350 also include markings 353 that may be illuminated by lights (e.g., light 122, etc.) of the vehicle 300 when the vehicle 300 is moving around the arena 350. In some aspects, the markings 353 may further include luminous materials (e.g., paints, markings, adhesives, etc.), luminescent materials (e.g., paints, markings, adhesives, etc.), or other materials that give off visible light through fluorescence, phosphorescence, radio luminescence, etc. Further, the lights of the vehicle 300 may include lights configured to make at least part of the markings 353 become visible (or become more visible) and/or glow when illuminated by the lights. As such, in these aspects, the vehicle 300 can leave a visible trail across the arena 350, with the lighted, glowing, etc. markings 353 generally indicating a path of travel for the vehicle 300 in the arena 350. In other example embodiments, the tiles 352*a*, 352*b* may also include markings 353. It should be appreciated that any desired arrangement of markings 353 can be used in the present disclosure.

Figure 6:
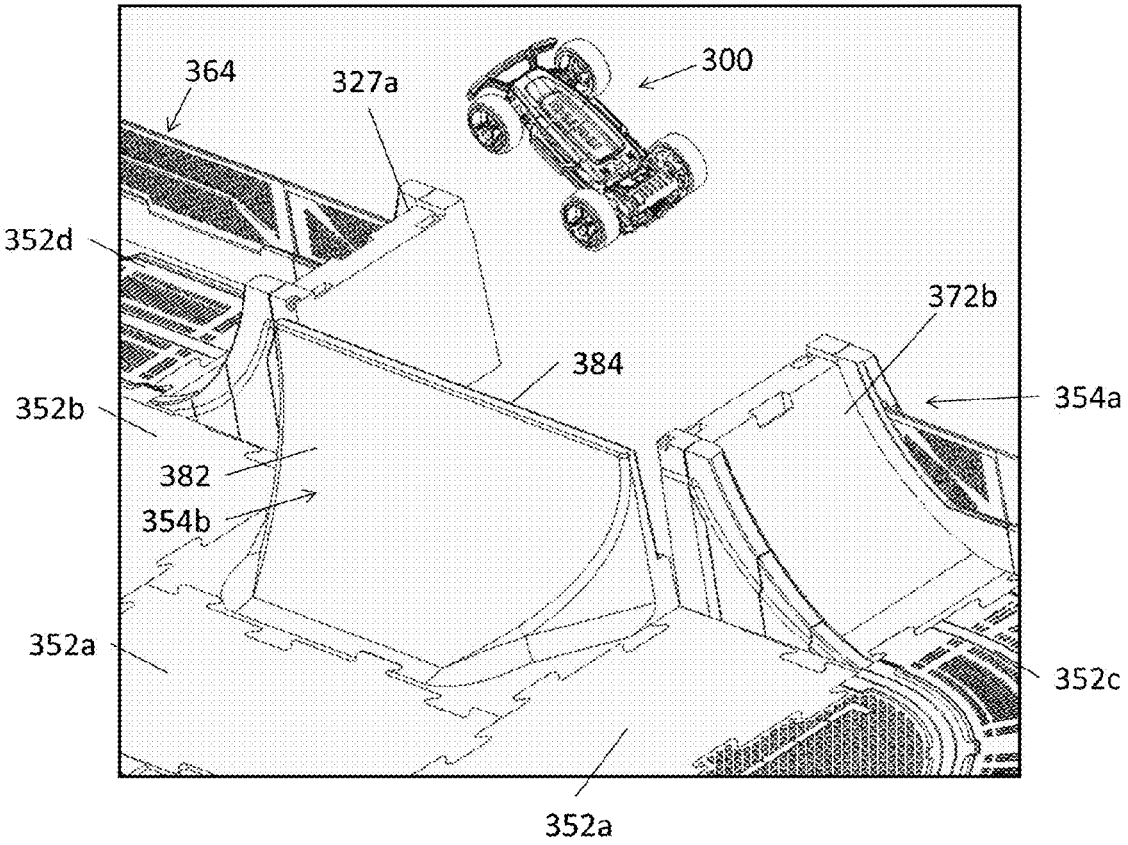
FIG. 6 is an enlarged perspective view of a stunt included with the arena of FIG. 5.

With reference to FIGS. 5 and 6, the stunt 354*a* includes a pair of generally aligned and spaced apart ramps 372*a*, 372*b*. This stunt 354*a* allows the remote control vehicle 300 to jump from one ramp 372*a* to the other ramp 372*b* (FIG. 6). For example, the vehicle 300 can engage (and take off from) either one of the ramps 372*a*, 372*b* of the stunt 354*a* and then land on the other one of the ramps 372*a*, 372*b* to thereby perform a jump maneuver using the stunt 354*a*. In FIG. 6, the vehicle 300 is shown performing a jump maneuver, after engaging and taking off from the ramp 372*b*.

As also shown in FIGS. 5 and 6, the stunt 354*b* includes a quarter pipe section 382 (with an upper portion 384 of the quarter pipe section 382 oriented generally vertically). This stunt 354*b* allows the remote control vehicle 300 to perform jumps, rolls, etc. depending on an angle upon which the vehicle 300 engages the quarter pipe section 382. For example, the vehicle 300 can engage the quarter pipe section 382 generally square and jump generally vertically into the air, or the vehicle 300 can engage the quarter pipe section 382 at an angle and roll over, etc.

Figure 7:
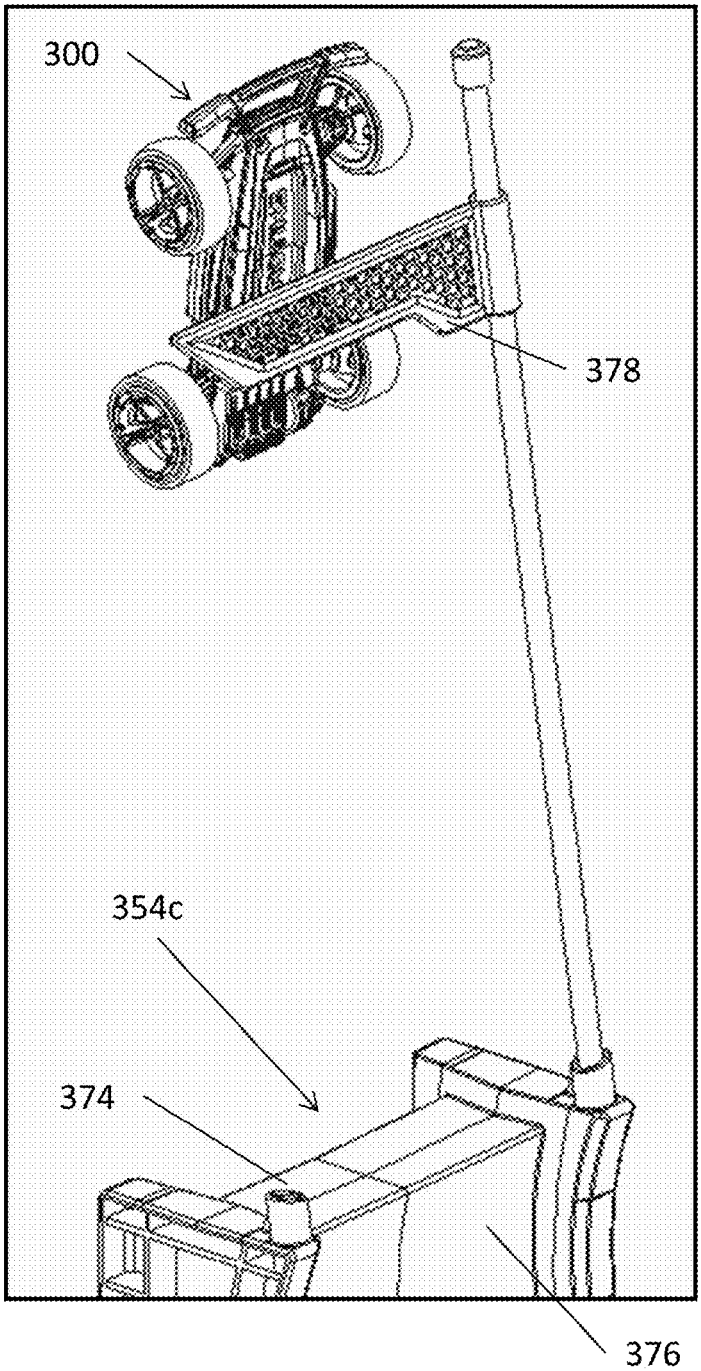
FIG. 7 is an enlarged perspective view of another stunt included with the arena of FIG. 5.

With reference to FIGS. 5 and 7, the stunt 354*c* also includes a pair of ramps 372*a*, 372*b*. The ramps 372*a*, 372*b* of this stunt 354*c* are substantially the same as the ramps 372*a*, 372*b* of the stunt 354*a*, previously described, and could be interchanged therewith as desired. Here, the ramps 372*a*, 372*b* are oriented generally back-to-back, and extenders 374, 376 are coupled to upper portions of the ramps 372*a*, 372*b*. The ramps 372*a*, 372*b*, when positioned back-to-back, may be coupled together by suitable fasteners, or they may be simply positioned adjacent each other (this can apply to all stunts herein that include the ramps 372*a*, 372*b*). And, the extenders 374, 376 comprise different orientations than the upper portions of the ramps 372*a*, 372*b*, to thereby cause the vehicle 300 to perform a different maneuver when engaging the extenders 374, 376 than when engaging the ramps 372*a*, 372*b* alone (i.e., the ramps 372*a*, 372*b* without the extenders 374, 376) (this can apply to all extenders herein).

Figure 8:
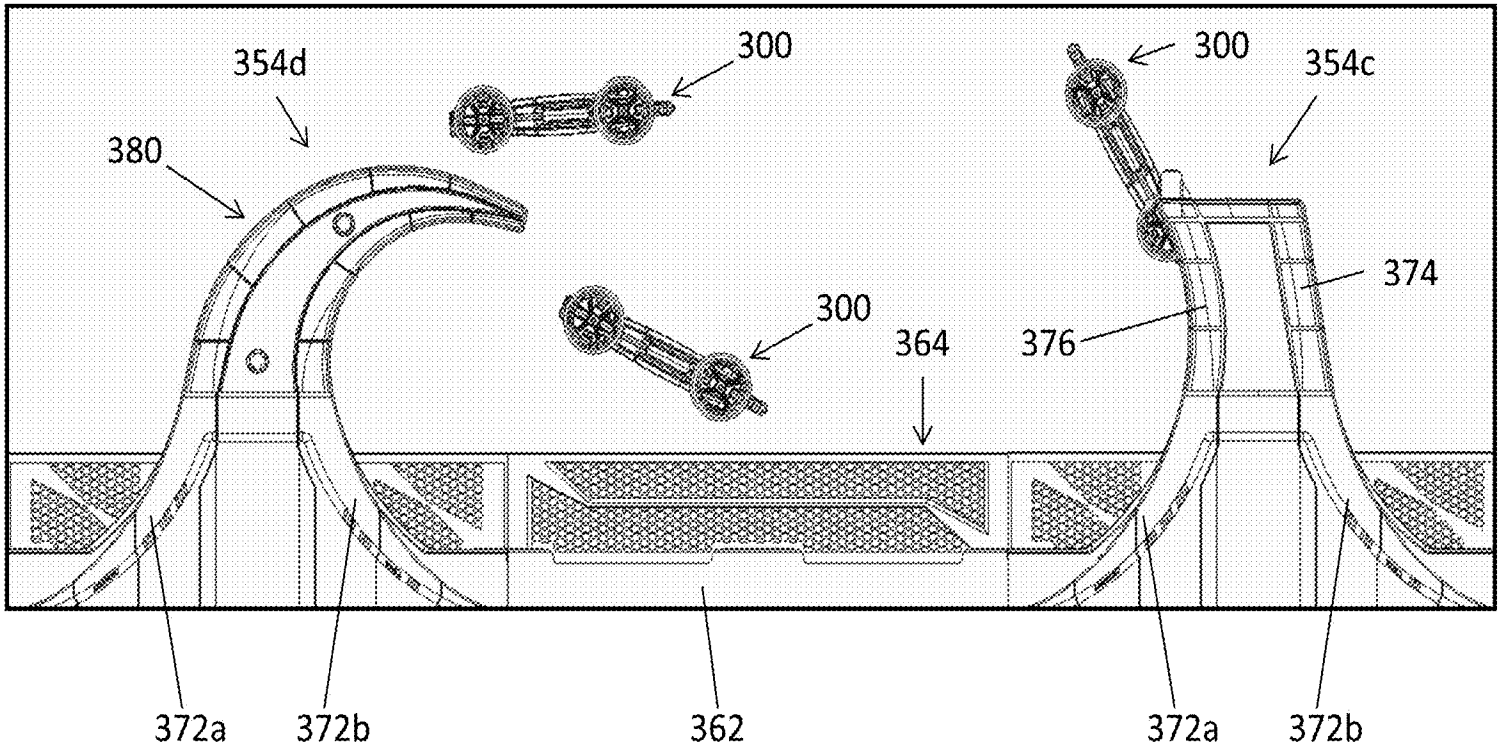
FIG. 8 is an enlarged side view of another stunt included with the arena of FIG. 5.

The stunt 354*c* allows the remote control vehicle 300 to perform a generally vertical jump (e.g., a jump to achieve maximum vertical height, etc.) (FIG. 7), or a generally backward, launching horizontal jump (see FIG. 8). For example, in one aspect the vehicle 300 can engage (and take off from) the ramp 372*a* (and its corresponding extender 374 which extends generally vertically from the ramp 372*a*) and jump generally vertically into the air (FIG. 7). In connection with this maneuver, the stunt 354*c* also includes an adjustable flag 378 that can be selectively positioned generally vertically to identify a height distance achieved by the vehicle 300 in performing the jump maneuver. And in another aspect, the vehicle 300 can engage (and take off from) the ramp 372*b* (and its corresponding extender 376 which is curved and extends generally past vertical) and jump generally upwardly and horizontally into the air (FIG. 8). In other example embodiments, arenas may include stunts with extenders formed separately from ramps and configured to couple thereto, or extenders formed integrally with ramps, etc.

And, with reference to FIGS. 5 and 8, the stunt 354*d* also includes a pair of ramps 372*a*, 372*b*. Again, the ramps 372*a*, 372*b* of this stunt 354*d* are substantially the same as the ramps 372*a*, 372*b* of the stunt 354*a* and the ramps 372*a*, 372*b* of the stunt 354*b*, previously described, and could be interchanged therewith as desired. Here, the ramps 372*a*, 372*b* are oriented generally back-to-back, and a barrel section 380 (broadly, an extender) is coupled to upper portions of the ramps 372*a*, 372*b*. This stunt 354*d* allows the remote control vehicle 300 to perform generally horizontal jumps, either right-side up or upside down. For example, the vehicle 300 in the arena 350 can engage (and take off from) either one of the back-to-back ramps 372*a*, 372*b* (and the barrel section 380 coupled thereto) and jump generally horizontally. In one aspect, the vehicle 300 can engage the ramp 372*a* and drive generally over the barrel section 380 (to jump generally horizontally). And in another aspect, the vehicle 300 can engage the ramp 372*b* and drive generally under the barrel section 380 (to jump generally horizontally). In the illustrated embodiment, the barrel section 380 of the stunt 354*d* is constructed from two portions that are configured to couple together and then couple to the upper portions of the ramps 372*a*, 372*b*. In other example embodiments, arenas may include stunts with barrel sections formed from single portions, or barrel sections formed from more than two portions, or barrel sections formed integrally with ramps, etc.

In FIG. 8, the remote control vehicle 300 is shown performing an example maneuver utilizing a combination of stunt 354*c* and stunt 354*d*. Here, the stunts 354*c*, 354*d* are arranged slightly differently than illustrated in FIG. 5. For example, here the vehicle 300 initially engages the ramp 372*a* of stunt 354*d* and drives generally under the barrel section 380. The vehicle 300 then engages the ramp 372*b* and extender 376 of stunt 354*c* and jumps generally horizontally onto an upper portion of the barrel section 380 of the stunt 354*d* (and then eventually down the ramp 372*b*). With that said, it should be appreciated that various other maneuvers can be performed using different combinations, constructions, etc. of the stunts 354*a-d* in the arena 350. What's more, the stunts 354*a-d* may be arranged and/or configured differently than illustrated herein to allow users to perform even other maneuvers.

In the illustrated embodiment, the fences 364 are positioned on the lips 362 of the outer tiles 352*c*, 352*d* of the arena 350 (generally along a portion of the outer boundary of the arena 350). And, the stunts 354*a-d* are configured to be positioned between select ones of the outer tiles 352*c*, 352*d* at locations generally along the outer boundary of the arena 350 (between sections of fences 364). The illustrated stunts 354*a-d* also include fence portions that are capable of coupling to the fences 364. As such, the perimeter of the arena 350 is generally defined by both fences 364 and select stunts 354*a-d*, and thus includes portions with the fences 364 (e.g., along the lips 362 of the outer tiles 352*c*, 352*d*, etc.) and portions without fences (e.g., at the stunts 354*a-d*, etc.). Further, the fences 364 and select stunts 354*a-d* also define a generally open area for driving a remote control vehicle in the arena. And in the illustrated embodiment, this area is not a loop (or donut) configuration, and could be any configured desired by a user.

The fences 364 also define a generally partial barrier along the outer tiles 352*c*, 352*d* which helps keep the remote control vehicle 300 in the arena 350 (e.g., helps prevent the vehicle 300 from bouncing out of the arena 350 at the outer tiles 352*c*, 352*d*, etc.) when driving in the arena 350, when performing maneuvers in the arena 350, etc. In addition, the lips 362 and/or fences 364 also operate to help guide the vehicle 300 in the arena 350 toward the stunts 354*a-d*. For example, as the vehicle 300 is driving around the arena 350, it engages a portion of the lips 362 and/or the fences 364 which then tends to guide the vehicle 300 toward one of the stunts 354*a-d* by maintaining generally steady contact with a portion of the vehicle 300 while the vehicle 300 moves therealong. In other example embodiments, arenas may include stunts positioned at inner locations of the arenas and/or along outer boundaries of the arenas. In still other example embodiments, stunts may be formed by hooking flexible sheets of plastic into guides of frames to form the desired stunts (e.g., jumps, loops, etc.).

The fences 364 are also configured to allow viewing the remote control vehicle 300 in the arena 350 through the fences 364 (e.g., the fences 364 are formed with openings therein, etc.). This allows users to view action in the arena 350 without obstruction from the fences 364. This also allows users to maintain continuous control of the vehicle 300 in the arena 350 (e.g., helps maintain a line of sight between a remote control and the vehicle 300 in the arena 350 for transmission/reception of operational signals, etc.) without obstruction from the fences 364.

Also in the illustrated embodiment, the tiles 352*a-d* and the stunts 354*a-d* of the arena 350 are arranged generally in a grid system to form the driving area of the arena 350. As part of this arrangement, the tiles 352*a-d* and the stunts 354*a-d* are uniquely sized so that they can be positioned to easily form desired configurations for the arena 350. With that said, the illustrated tiles 352*a-d* and stunts 354*a-d* are either full size, half size, or quarter size. Specifically, the tiles 352*b*, 352*c* are full size; the tiles 352*a*, 352*d* and the stunt 354*d* are half size; and the ramps 372*a*, 372*b* forming stunts 354*a-c* are quarter size (with the resulting stunts 354*a-c* actually being half size).

Further in the illustrated embodiment, the ramps 372*a*, 372*b* of each of the stunts 354*a-c* are generally the same and can be interchanged and used in connection with any of the stunts 354*a-c*. In addition, the extenders 374, 376 and the barrel section 380 of stunts 354*b*, 354*c* can be interchanged with any of the ramps 372*a*, 372*b* as desired. As such, the stunts 354*a-c* can be reconfigured as desired to allow remote control vehicles to perform different maneuvers, etc.

In use of the arena 350, remote control vehicle 300 can be operated in the arena 350 to engage the stunts 354*a-d* and perform various maneuvers, as desired. The vehicle 300 can move around the floor of the arena 350 and engage the stunts 354*a-d* at desired speeds, angles, etc. The operator can move the vehicle 300 around the arena 350 in any way desired and through the various stunts 354*a-d* in any desired order, speed, etc. The movement of the vehicle 300 is substantially free-form. What's more, the generally enclosed environment of the arena 350 allows users to quickly perform repeated stunts 354*a-d*. Moreover, the stunts 354*a-d* are configured to allow the vehicle 300 to perform areal acrobatic maneuvers. For example, users operating the vehicle 300 may increase, decrease, reverse, etc. operational power to a drive motor of the vehicle 300 to thereby modify, create, etc. a torque on the vehicle 300 as the vehicle 300 jumps in the air to cause the vehicle 300 to perform acrobatic maneuvers in the air. And still further, the stunts 354*a-d* may be configured to direct the vehicle 300 out of the arenas (e.g., into other arenas, to other desired locations, etc.) as desired.

In example embodiments of the present disclosure where remote control vehicles used in the arenas do not include steering (e.g., remote control vehicle 100, 300, etc.), a user can still perform numerous stunts in the arenas by simply actuating a trigger of a remote control associated with the vehicle (e.g., for an extended period of time, etc.). In addition, over time the user may learn how to control the vehicle with some finesse (eventhough the vehicle does not include steering). For example, the user may learn that the vehicle can be freed when it gets hung up on a stunt by driving in reverse, or the user may learn to control flight characteristics of the vehicle (after jumping into the air) by changing the speed and direction of a drive motor of the vehicle in midair, etc.

In other example embodiments, radio frequency identification (RFID) readers and/or optical readers may be installed in arenas (e.g., in tiles of the arenas, in fences of the arenas, in stunts of the arenas, etc.) to sense, for example, locations of remote control vehicles in the arenas, when remote control vehicles jump out of the arenas, etc.). In embodiments where the readers sense when remote control vehicles jump out of the arenas, the readers may then communicate with the vehicles after they jump out of the arenas to stop power to the vehicles.

In still other example embodiments, arenas may include more stunts or less stunts than disclosed herein. In addition, other example embodiments may include arenas with stunts different from those disclosed herein (e.g., tunnels, other stunts configured to launch a remote control vehicle into the air, other stunts configured to allow a remote control vehicle to perform an acrobatic maneuver, etc.).

Figure 9:
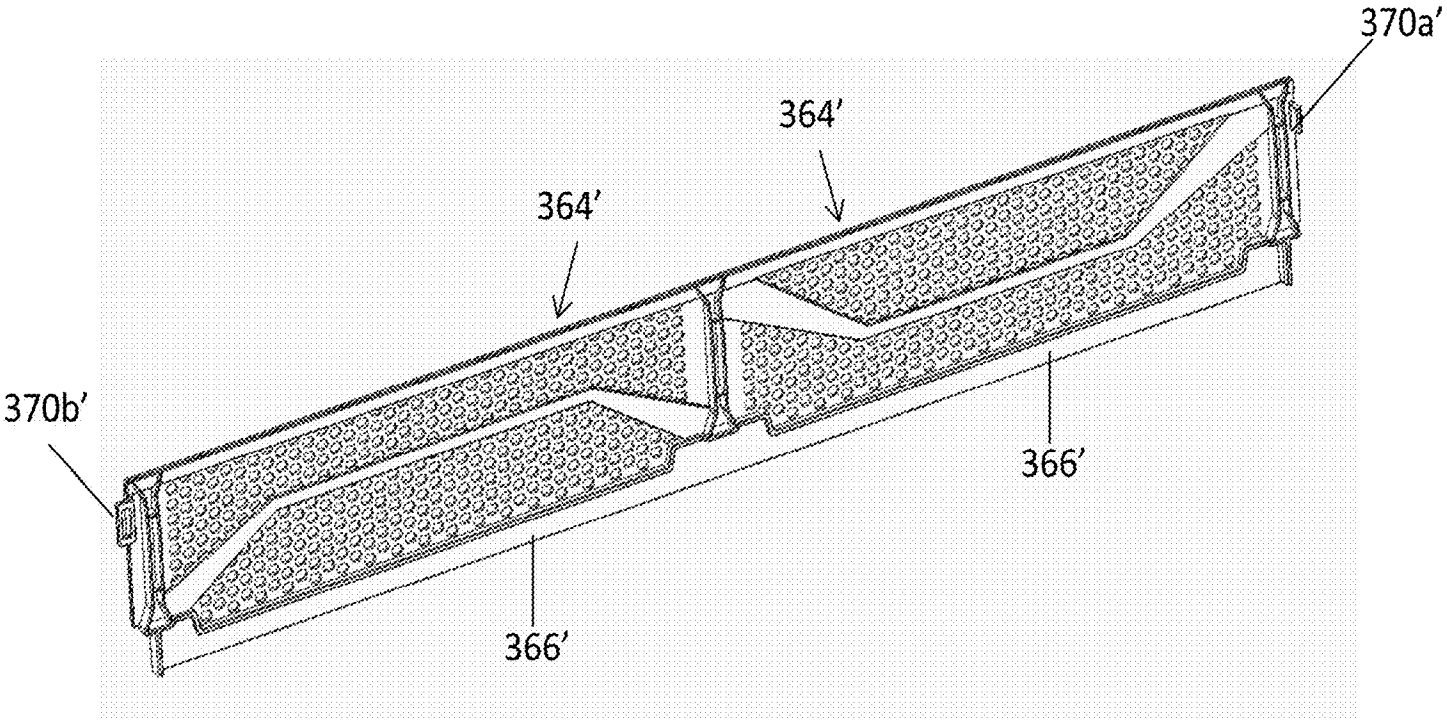
FIG. 9 is a perspective views of an example embodiment of a fence configured for use with arenas of the present disclosure.
Figure 10:
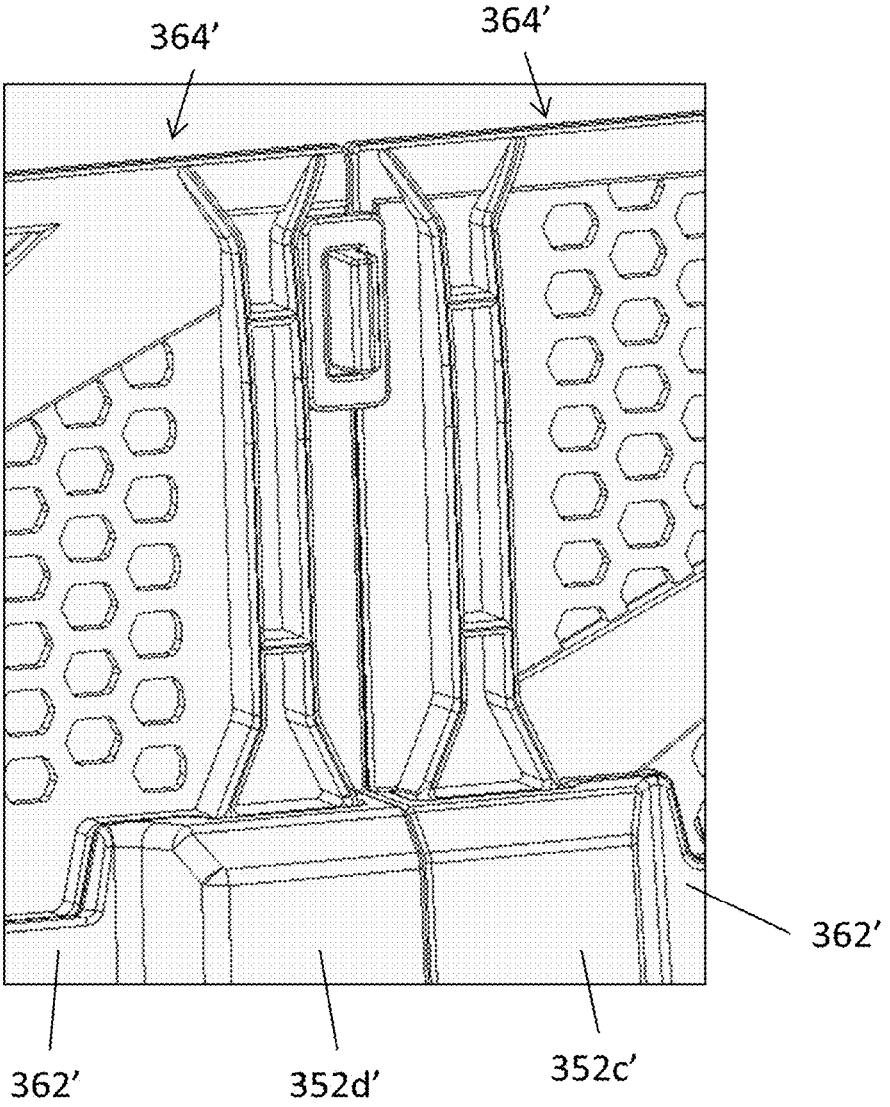
FIG. 10 is an enlarged perspective view of the fence of FIG. 9, further shown installed in an arena of the present disclosure.

FIGS. 9 and 10 illustrate another example embodiment of a fence 364' configured for use with an arena (e.g., arena 350, any of the arenas of the present disclosure, etc.). The fence 364' is substantially similar to the fence 364 previously described with reference to FIGS. 5-8 for the arena 350. In this embodiment, however, the fence 364' generally includes a footing 366' configured to fit in a corresponding opening in a lip 362' of tiles 352*c*', 352*d*' to thereby couple the fence 364' to the lip 362' of the tiles 352*c*', 352*d*'. In addition, mating tabbed connectors 370*a*', 370*b*' are provided for connecting adjacent fences 364' together and, in some aspects, helping hold corresponding tiles 352*c*', 352*d*' together, etc.

Figure 11:
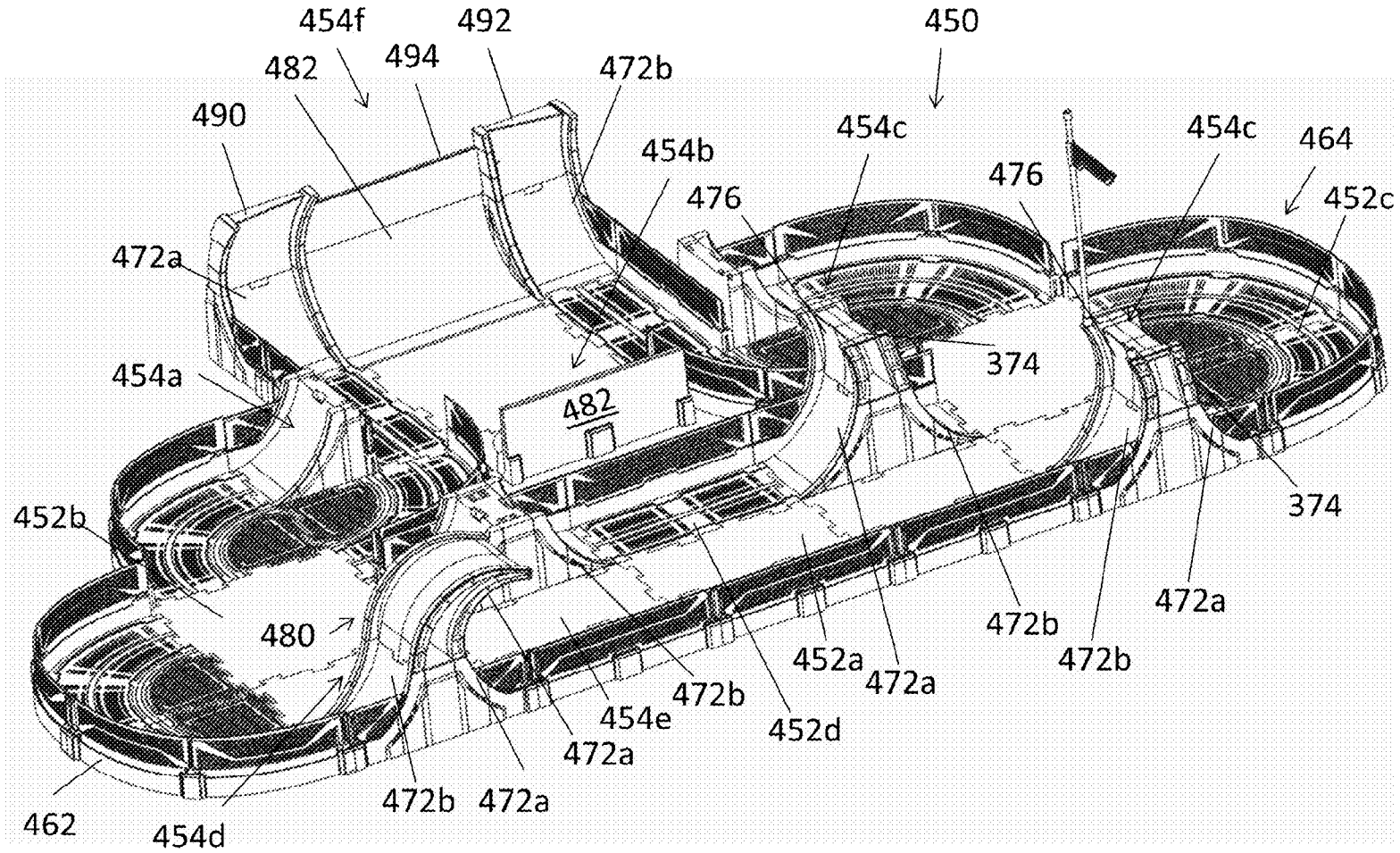
FIG. 11 is a perspective view of an arena according to another example embodiment of the present disclosure, where a remote control vehicle can be used in the arena to engage various stunts and perform various acrobatic maneuvers.

FIG. 11 illustrates an arena 450 (e.g., a stunt arena, etc.) according to another example embodiment of the present disclosure. And again, the remote control vehicle 100 and the remote control 230 previously described and illustrated in FIGS. 1-4 can be used in connection with the arena 450, for example, to perform desired maneuvers, etc.

Components of the arena 450 of this embodiment are substantially similar to those described in connection with the arena 350 illustrated in FIGS. 5-8 (except the components are interconnected in a different configuration). For example, the arena 450 includes multiple tiles 452*a-d* and multiple stunts 454*a-d* arranged to form the arena 450. The tiles 452*a-d* and the stunts 454*a-d* are configured to interlock with adjacent tiles 452*a-d* and/or stunts 454*a-d* to help hold them in place, together, etc. (as previously described for the tiles 352*a-d* and the stunts 354*a-d* of the arena 350). Outer tiles 452*c*, 452*d* of the arena 450 each include a raised lip 462 extending along an outer side portion of the tile 452*c*, 452*d*. And, fences 464 are coupled to the lips 462 of the outer tiles 452*c*, 452*d*.

In addition, the stunt 454*a* includes a pair of generally aligned and spaced apart ramps 472*a*, 472*b* which allows a remote control vehicle in the arena 450 to jump from one ramp 472*a*, 472*b* to the other ramp 472*a*, 472*b* (e.g., over a portion of the arena 450, etc.). The stunt 454*b* includes a quarter pipe section 482 which allows a remote control vehicle in the arena 450 to perform jumps, rolls, etc. depending on an angle upon which the vehicle engages the quarter pipe section 482. The stunt 454*c* (two versions of stunt 454*c* are included in the arena 450) also includes a pair of ramps 472*a*, 472*b* oriented generally back-to-back, and extenders 474, 476 coupled to upper portions of the ramps 472*a*, 472*b*. Each stunt 454*c* allows a remote control vehicle in the arena 450 to perform a generally vertical jump (e.g., a jump to achieve maximum vertical height, etc.). And, the stunt 454*d* includes a pair of ramps 472*a*, 472*b* oriented generally back-to-back, and a barrel section 480 coupled to upper portions of the ramps 472*a*, 472*b*. This stunt 454*d* allows a remote control vehicle in the arena 450 to perform generally horizontal jumps, either right-side up or upside down.

The arena 450 of this embodiment further includes stunts 454*e*, 454*f*. The stunt 454*e* includes a pair of ramps 472*a*, 472*b* oriented generally back-to-back. This stunt allows a remote control vehicle in the arena 450 to jump, for example, from one ramp 472*a*, 472*b* to the other ramp 472*a*, 472*b*, etc. And, the stunt 454*f* includes a pair of ramps 472*a*, 472*b* spaced apart with a quarter pipe section 482 positioned therebetween. Sloped extenders 490, 492 are coupled to upper portions of the ramps 472*a*, 472*b*, and a scoop extender 494 is coupled to an upper portion of the quarter pipe section 482. In one aspect, this stunt 454*f* allows a remote control vehicle in the arena 450 to perform a generally vertical, twisting jump (e.g., a jump that launches a remote control vehicle upwardly and inwardly, etc.). For example, the vehicle can engage (and take off from) ramp 472*a* (and its corresponding sloped extender 490) and jump upwardly into the air and inwardly (to the right in FIG. 11) to thereby perform a generally twisting jump maneuver. In addition, the vehicle can engage (and take off from) ramp 472*b* (and its corresponding sloped extender 482) and jump upwardly into the air and inwardly (to the left in FIG. 11) to thereby perform another generally twisting jump maneuver. And in another aspect, the stunt 454*f* allows a remote control vehicle in the arena 450 to perform reverse jumps, rolls, etc. depending on an angle upon which the vehicle engages the quarter pipe section 482. For example, the vehicle can engage the quarter pipe section 482 and scoop extender 494 generally square and perform a back-flip jump sending the vehicle back into the arena 450, or the vehicle can engage the quarter pipe section 482 of the stunt 454*f* at an angle and roll over, etc.

In addition in this embodiment, the stunt 454*f* can be modified by removing the sloped extenders 490, 492 and/or scoop extender 494 from the respective ramps 472*a*, 472*b* and quarter pipe section 482. In one aspect, the stunt 454*f* then includes the ramps 472*a*, 472*b* for a remote control vehicle in the arena 450 to perform basic jumps (e.g., jumps from the arena 450 to an adjacent arena, jumps out of the arena 450, etc.), and the quarter pipe section 482 for the vehicle to perform generally vertical jumps and/or rolls. In another aspect, the arena 450 (with the modified stunt 454*f*) can be positioned with the modified stunt 454*f* against a wall. Here, the vehicle in the arena 450 can engage the stunt 454*f* and drive generally up the wall.

FIGS. 12-15 illustrate a stunt 554*g* according to another example embodiment of the present disclosure. The stunt 554*g* can be included in an arena of the present disclosure (e.g., arena 350, 450, 650, etc.) or any other arena. And, a remote control vehicle 500 (or any other remote control vehicle (e.g., remote control vehicle 100, 300, etc.; other remote control vehicles disclosed herein; other remote control vehicles; etc.) or combinations of remote control vehicles) can be operated in connection with the stunt 554*g*, for example, to perform desired maneuvers, etc.

Figure 12:
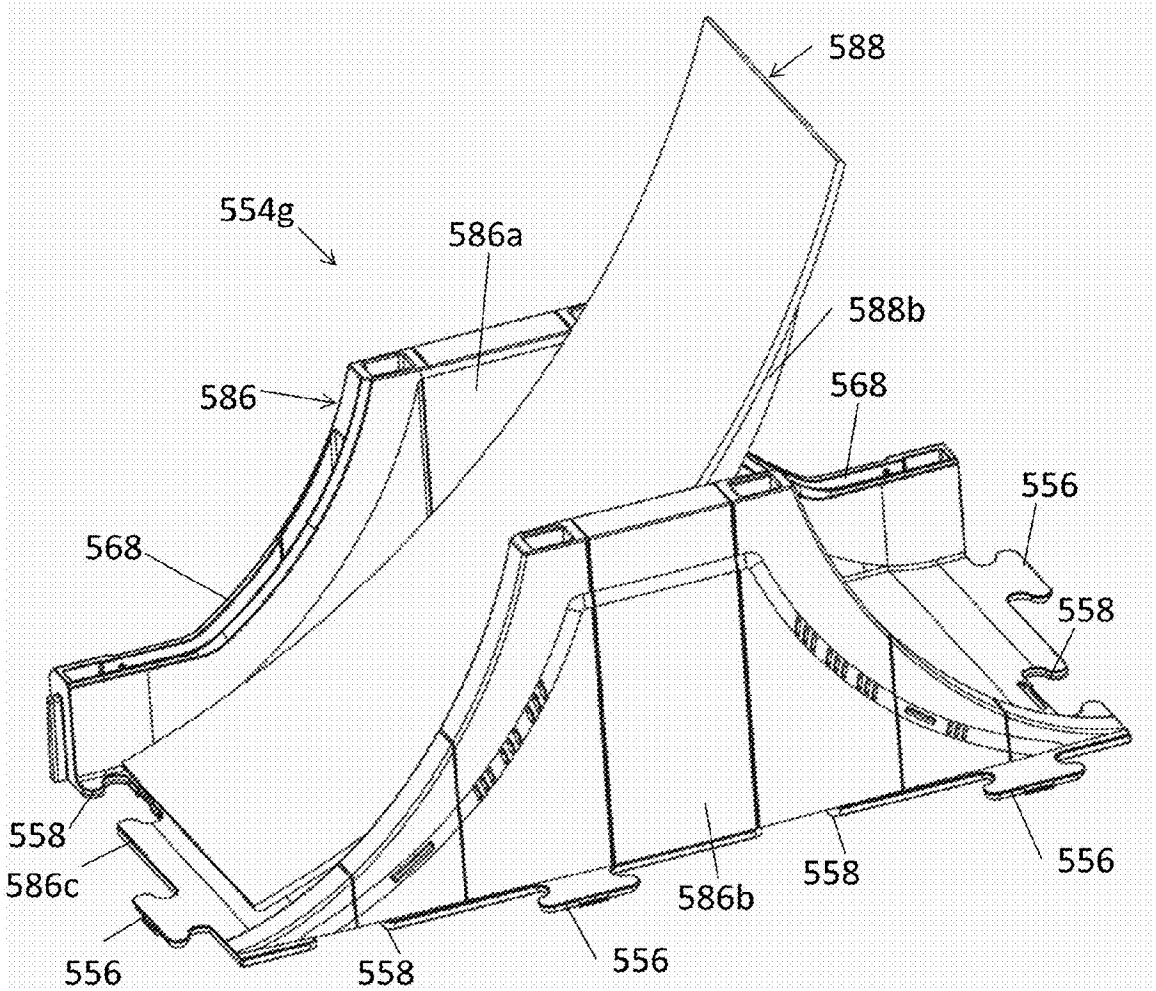
FIG. 12 is a perspective view of a stunt according to an example embodiment of the present disclosure and suitable for use in arenas, where a remote control vehicle can be used in the arena to engage the stunt and perform various acrobatic maneuvers.
Figure 13:
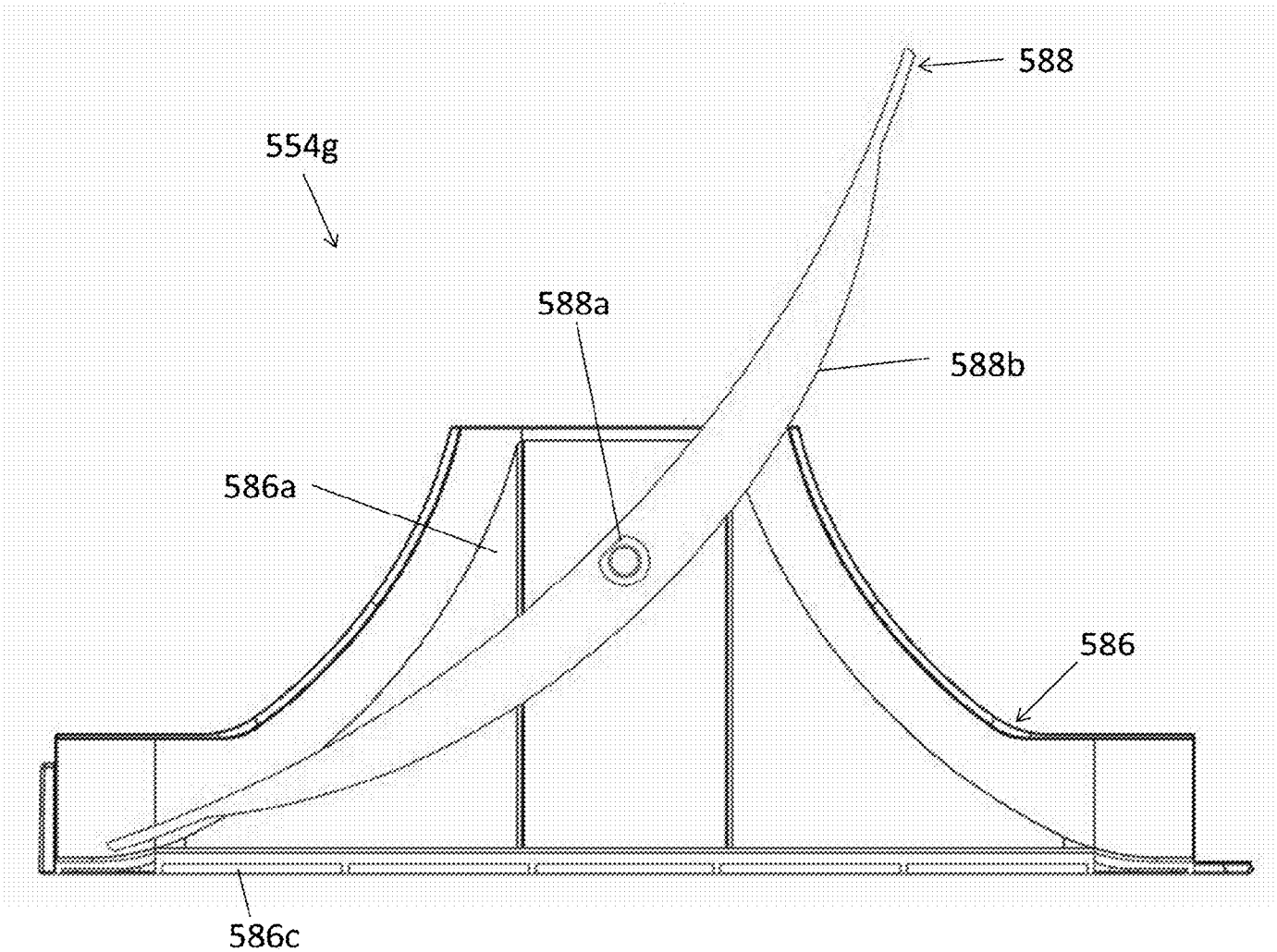
FIG. 13 is a side view of the stunt of FIG. 12, with a wall portion of a body of the stunt removed to show assembly details of the stunt.

As shown in FIGS. 12 and 13, the stunt 554*g* generally includes a body 586 and a ramp 588 coupled to the body 586. In the illustrated embodiment, the body 586 defines a generally "U" shape, and includes sidewalls 586*a*, 586*b* and a base 586*c*. The ramp 588 is coupled to the body 586 at the sidewalls 586*a*, 586*b*. In particular, the ramp 588 includes tabs 588*a* (only one tab 588*a* is visible in FIG. 13) configured to be received in openings of the sidewalls 586*a*, 586*b* to thereby couple the ramp 588 to the body 586. In other example embodiments, stunts may include ramps coupled to bodies by other means, for example, tabs on the bodies configured for receipt in openings of the ramps, pins extending from the sidewalls and through the ramp, etc. In still other example embodiments, stunts may include bodies with shapes other than illustrated herein, for example, other than generally "U" shape, etc.

Figure 15:
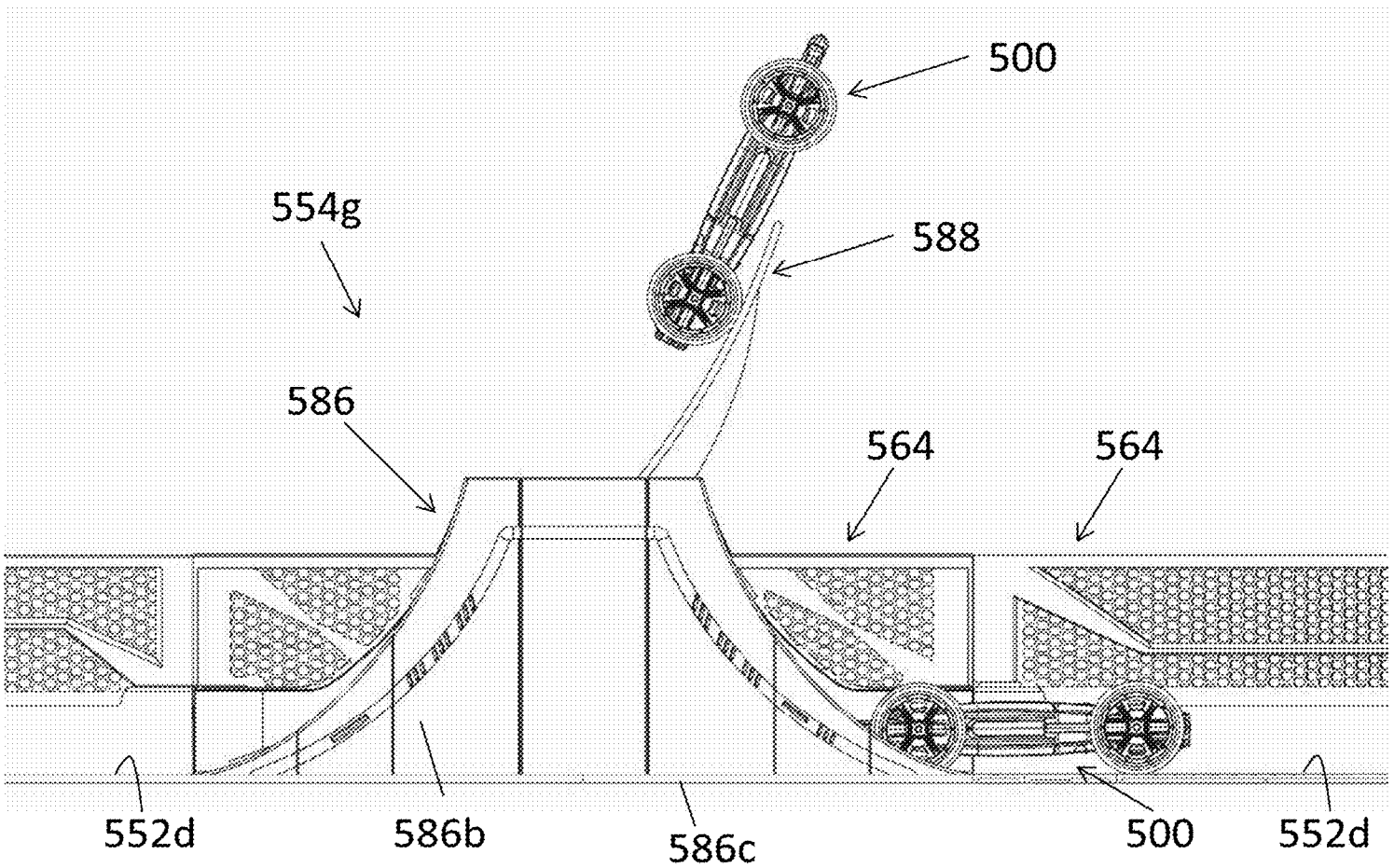
FIG. 15 is a side view of the stunt of FIG. 12, with the stunt included in an arena.

Fences 564 can also be coupled to the body 586 of the stunt 554*g* (FIG. 15). In the illustrated embodiment, the sidewalls 586*a*, 586*b* of the body 586 include openings 568 configured to receive the fences 564. The fences 564 then operate as described for other fences herein.

When included in an arena (FIG. 15), the stunt 554*g* can be positioned at various locations around a floor of the arena so that the remote control vehicle 500 can selectively engage the stunt 554*g* (along with other stunts) as it drives across the floor. As such, the stunt 554*g* is configured to interlock with adjacent tiles (e.g., tiles 552*d* in FIG. 15) and/or stunts to help hold it in place, together, etc. in a desired configuration. This also helps provide a smooth transition between the tiles and the stunt 554*g* for driving the vehicle 500. In the illustrated embodiment, various edges of the stunt 554*g* include teeth 556 configured to fit into corresponding openings located in edges of adjacent tiles and/or stunts, and openings 558 configured to receive corresponding teeth located in edges of the adjacent tiles and/or stunts, to thereby interlock the stunt 554*g* with the adjacent tiles and/or stunts. In other example embodiments, stunts may include other structures (e.g., other configurations of releasable fasteners, etc.) configured to interlock them with adjacent tiles and/or stunts, as desired.

The ramp 588 of the stunt 554*g* is generally arcuate in shape, and provides a platform to launch the remote control vehicle 500 into the air when using the stunt 554*g*. Ribs 588*b* are provided along a lower portion of the ramp 588 to help reinforce the ramp 588. The ramp 588 can be formed having any desired angle, or combination of angles, to facilitating launching the vehicle 500. The illustrated ramp 588 includes a generally changing angle that defines a scoop or generally "U" shaped configuration. Alternatively, the ramp 588 may have shallower angles if it is desired to launch the vehicle 500 in a more horizontal direction, or if the vehicle 500 is relatively long (e.g., to help inhibit the vehicle from dragging when it engages the ramp, etc.). Or, the ramp 588 may have steeper angles if it is desired to launch the vehicle 500 in a more vertical direction, or if the vehicle 500 is relatively short. In other example embodiments, stunts may include ramps with shapes other than illustrated herein, for example, generally planar shapes with generally constant angles, etc.

Figure 14:
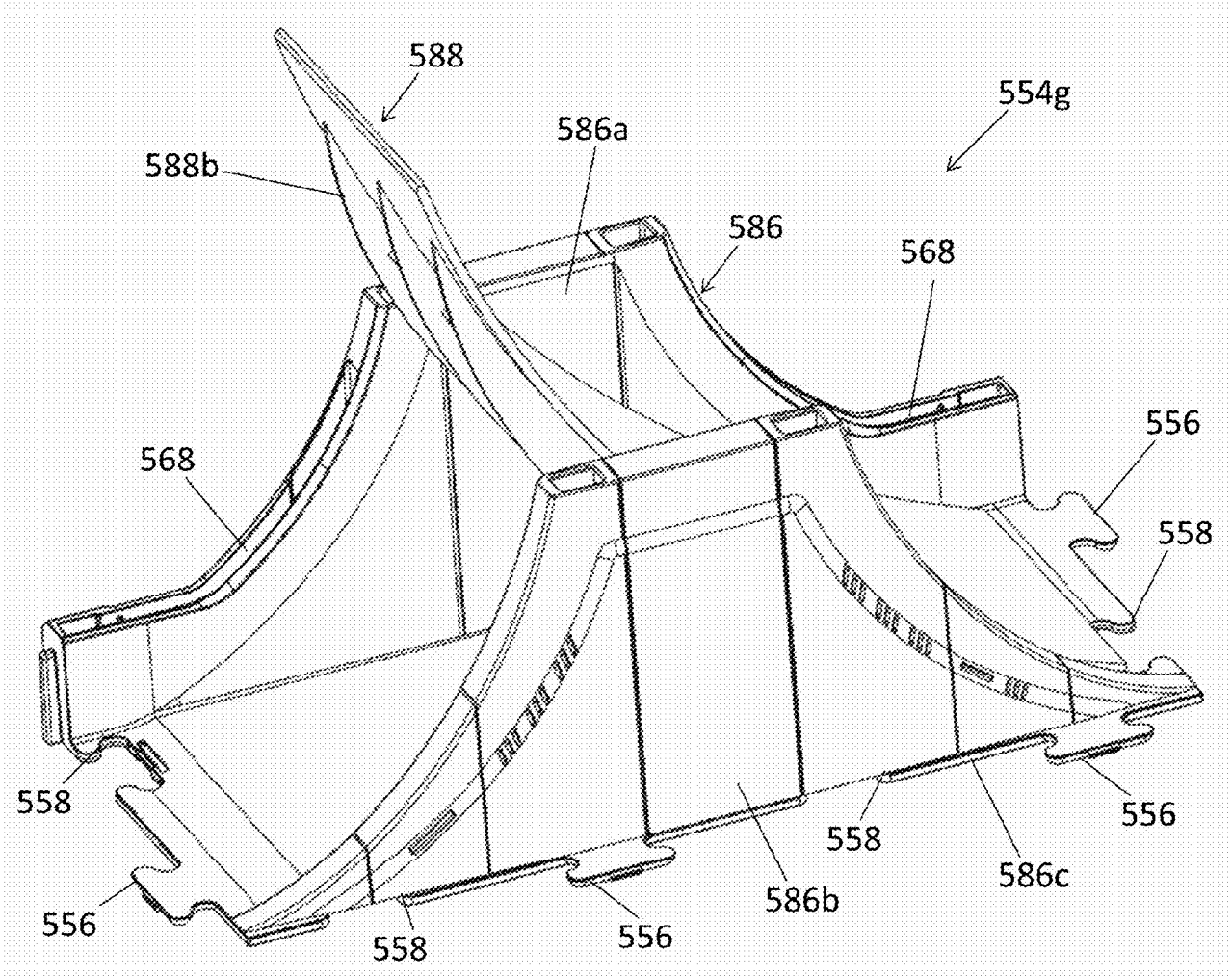
FIG. 14 is the perspective view of FIG. 12, with a ramp of the stunt pivoted from a first position, as shown in FIG. 12, to a second position.

With additional reference to FIGS. 14 and 15, the ramp 588 is also configured to pivot relative to the body 586 (via the tabs 588*a* and openings). For example, the ramp 588 can pivot between a first position shown in FIG. 12 and a second position shown in FIG. 14. As such, in one aspect, the remote control vehicle 500 can engage an upper surface of the ramp 588, drive generally over the ramp 588, and perform a jump maneuver. This can also cause the ramp 588 to generally pivot between the first and second positions. In another aspect, the vehicle 500 can engage a lower surface of the ramp 588, and drive generally under the ramp 588 and through the body 586. This again can cause the ramp 588 to generally pivot between the first and second positions.

In FIG. 15, two remote control vehicles 500 are shown performing example maneuvers utilizing the stunt 554*g*. One of the vehicles 500 is shown engaging an upper surface of the ramp 588, and jumping generally vertically. And, the other one of the vehicles 500 is shown in a position driving under the ramp 588 and through the body 586. With that said, it should be appreciated that various other maneuvers can be performed using the stunt 554*g*, for example, depending on positioning of the ramp 588, etc.

Figure 16:
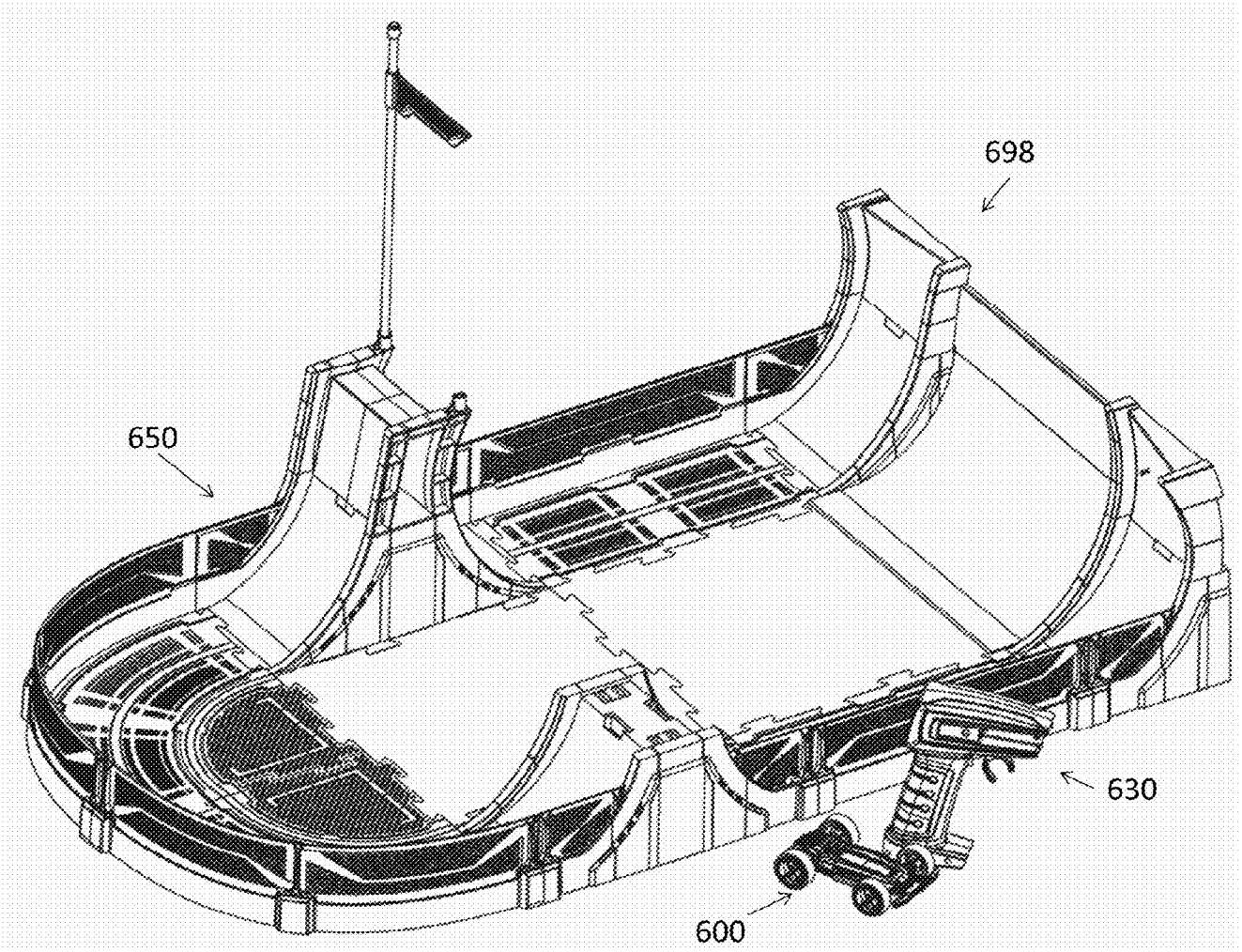
FIG. 16 is a stunt arena assembly according to an example embodiment of the present disclosure, where the assembly includes a remote control vehicle, a remote control, and an arena.

FIG. 16 illustrates a stunt arena assembly 698 according to an example embodiment of the present disclosure. The assembly 698 generally includes a remote control vehicle 600, a remote control 630, and an arena 650. In some aspects, the stunt assembly 698 is provided in packaging (e.g., to facilitate shipping, storage, display, etc.), that includes the vehicle 600, the remote control 630, and the arena 650. And, in some aspects, the arena 650 is provided unassembled in the packaging (such that the user can then assemble the components of the arena 650 in a desired arrangement). In some example embodiments, stunt arena assemblies may include remote control vehicles without batteries. In some example embodiments, stunt arena assemblies may include remote control vehicles with one battery for use with the vehicles. And in other example embodiments, stunt arena assemblies may include multiple batteries for use with remote control vehicles, such that one of the batteries can be used to operate the remote control vehicles while other ones of the batteries are charged (e.g., using remote controls of the assemblies, etc.). In some example embodiments, stunt arena assemblies may include any combination of remote control vehicles, remote controls, stunts, and/or arenas provided herein.

In some example embodiments, remote control vehicles may include lights (e.g., ultraviolet lights, etc.) included therewith (e.g., mounted to frames of the vehicles, etc.) configured to illuminate portions of arenas in which the vehicles are operated (e.g., portions of the arenas comprising luminous materials (e.g., paints, markings, adhesives, etc.); luminescent materials (e.g., paints, markings, adhesives, etc.); other materials that give off visible light through fluorescence, phosphorescence, radio luminescence, etc.; etc.). In addition, in some aspects of these embodiments, the arenas may include markings that become visible (e.g., glow, etc.) when illuminated by the lights on the vehicles, thereby leaving trails indicating paths of travel for the vehicles.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A stunt arena in which a remote control vehicle can be operated to engage stunts and perform acrobatic maneuvers, the stunt arena comprising:

multiple stunts engageable by the remote control vehicle, within the stunt arena, to perform the acrobatic maneuvers within the stunt arena; and fence segments disposed along part of an outer portion of the arena for enclosing at least part of the arena;

wherein:

at least one of the stunts is disposed along the outer portion of the arena generally between two fence segments;

the fence segments and the at least one of the stunts disposed along the outer portion of the arena define a generally closed driving area of the arena that is not a loop; and at least one of the fence segments is disposed to direct the remote control vehicle into engagement with the at least one of the stunts.

2. The stunt arena of claim 1, wherein the multiple stunts include at least two stunts configured to launch the remote control vehicle into the air.

3. The stunt arena of claim 1, wherein the multiple stunts include a stunt having two ramps.

4. The stunt arena of claim 3, wherein the two ramps are positioned generally back-to-back.

5. The stunt arena of claim 3, wherein the stunt further includes an extender coupled to an upper surface of at least one of the ramps, the extender comprising a different orientation than the upper surface of the at least one of the ramps.

6. The stunt arena of claim 1, wherein the multiple stunts include a barrel section.

7. The stunt arena of claim 1, wherein the multiple stunts include a first stunt having two ramps, a second stunt having two ramps, a third stunt having two ramps, and a fourth stunt having a barrel section.

8. The stunt arena of claim 7, wherein at least one of the multiple stunts further includes an extender configured to be coupled to the ramps of the at least one of the multiple stunts, and wherein the extender is interchangeable with at least one other of the multiple stunts such that the extender is also configured to be coupled to the ramps of the at least one other of the multiple stunts.

9. The stunt arena of claim 1, wherein at least one of the multiple stunts includes a body and a ramp pivotally coupled to the body, such that the ramp is operable to pivot relative to the body.

10. An assembly comprising the stunt arena of claim 1 in combination with the remote control vehicle.

11. The assembly of claim 10, wherein the remote control vehicle includes a variable speed motor having multiple operational settings for moving the remote control vehicle in different directions.

12. The assembly of claim 10, wherein the remote control vehicle includes a variable speed motor having multiple operational settings for moving the remote control vehicle at different speeds.

13. A stunt arena assembly comprising:

a remote control vehicle having wheels, wherein the wheels of the remote control vehicle are not steerable; and an arena having fences disposed along part of an outer portion of the arena, and stunts disposed along at least part of the outer portion of the arena and generally between the fences;

wherein the remote control vehicle is operable in the arena to engage the stunts and perform acrobatic maneuvers within the arena.

14. The stunt arena assembly of claim 13, wherein the stunts of the arena include a first stunt having two ramps and an extender configured to be coupled to at least one of the two ramps, and a second stunt having two ramps, wherein the extender is interchangeable with the second stunt such that the extender is also configured to be coupled to at least one of the two ramps of the second stunt.

15. The stunt arena assembly of claim 13, further comprising a remote control for use with the remote control vehicle, to control movement of the remote control vehicle in the arena.

16. The stunt arena assembly of claim 15, wherein the remote control includes a charging port for receiving and charging a battery configured for use with the remote control vehicle.

17. The stunt arena assembly of claim 15, wherein the remote control vehicle comprises a chassis and wheels coupled to the chassis, and wherein the wheels of the remote control vehicle are not steerable.

18. The stunt arena assembly of claim 17, wherein at least one of the fences is disposed to direct the remote control vehicle into engagement with at least one of the stunts.

19. The stunt arena assembly of claim 13, wherein the remote control vehicle includes at least one light, and wherein the arena includes at least one marking that becomes visible when illuminated by the light of the remote control vehicle.

20. The stunt arena assembly of claim 13, wherein the remote control vehicle includes a variable speed motor having multiple operational settings for moving the remote control vehicle at different speeds.

* * * * *